US011069266B1

(12) United States Patent
Wu

(10) Patent No.: US 11,069,266 B1
(45) Date of Patent: Jul. 20, 2021

(54) DISPLAY PANEL WITH GOA CIRCUIT INVALID DETECTION

(71) Applicant: WUHAN CHINA STAR OPTOELECTRONICS SEMICONDUCTOR DISPLAY TECHNOLOGY CO., LTD., Hubei (CN)

(72) Inventor: Shaojing Wu, Hubei (CN)

(73) Assignee: WUHAN CHINA STAR OPTOELECTRONICS SEMICONDUCTOR DISPLAY TECHNOLOGY CO., LTD., Hubei (CN)

( * ) Notice: Subject to any disclaimer, the term of this patent is extended or adjusted under 35 U.S.C. 154(b) by 492 days.

(21) Appl. No.: 16/302,643

(22) PCT Filed: Aug. 6, 2018

(86) PCT No.: PCT/CN2018/098966
§ 371 (c)(1),
(2) Date: Nov. 18, 2018

(87) PCT Pub. No.: WO2020/006802
PCT Pub. Date: Jan. 9, 2020

(30) Foreign Application Priority Data

Jul. 2, 2018 (CN) ..... 201810704350.4

(51) Int. Cl.
*G09G 3/00* (2006.01)
*G09G 3/36* (2006.01)

(52) U.S. Cl.
CPC ..... *G09G 3/006* (2013.01); *G09G 3/3677* (2013.01); *G09G 2300/0408* (2013.01); *G09G 2330/08* (2013.01)

(58) Field of Classification Search
USPC ..... 345/206
See application file for complete search history.

(56) References Cited

U.S. PATENT DOCUMENTS

2019/0027074 A1* 1/2019 Zeng ..... G09G 3/3677
2019/0064256 A1* 2/2019 Wang ..... H01L 27/1262

* cited by examiner

*Primary Examiner* — Ifedayo B Iluyomade
(74) *Attorney, Agent, or Firm* — Soroker Agmon Nordman

(57) ABSTRACT

A display panel with GOA circuit invalid detection is provided. A plurality of cascading gate-driver-on-array (GOA) circuit units are disposed in the display panel. The GOA circuit units are divided into a plurality of groups of GOA circuit units. The last stage of the GOA circuit units in each group of GOA circuit units is connected to a test line. One group of GOA circuit units is treated as a unit to detect whether any GOA circuit unit in each group is invalid. This improves accuracy in GOA circuit invalid detection.

16 Claims, 3 Drawing Sheets

DISPLAY PANEL WITH GOA CIRCUIT INVALID DETECTION

BACKGROUND

1. Field of the Disclosure

The present invention relates to display technologies, and more particularly, to a display panel with GOA circuit invalid detection.

2. Description of Related Art

Active-matrix organic light-emitting diode (AMOLED) display panels gradually become a new generation of display technologies for their high contrast, wide color gamut, lower power consumption, and foldable characteristics. Gate-driver-on-array (GOA) circuits are a core module of the display panel. Whether the GOA circuits function normally affects luminescence properties of the display panel directly.

GOA technology is a technology using an existing thin film transistor-liquid crystal display (TFT-LCD) array process to manufacture row scan driving circuits on an array substrate to achieve line-by-line or row-by-row scan driving. The GOA technology can reduce welding procedures in connecting to an external IC (Integrated Circuit), and can make a display panel become more suitable for manufacturing a display product with narrow bezel or without bezel.

FIG. 1 is a schematic diagram showing an existing display panel. The display panel includes a display region (or called an active area, AA) 10 and a non-display region. The display panel also includes a plurality of cascading GOA circuit units 11, such as GOA1, GOA2, . . . , GOAn, and a test line 12 connecting to a last stage of the GOA circuit units 11, that are disposed at left and right sides of the display panel and in the non-display region. The GOA circuit units 11 are connected to scan lines (not shown) in the display region 10 for providing stable scan signals to the scan lines.

Contingent events in the processes, mechanical collisions, or bending stress mismatch for a flexible panel may cause the GOA circuit units 11 to be invalid. In GOA circuit invalid detection, a signal of a last stage (i.e., an output signal of GOAn) is only detected in existing arts. It can only be sure whether GOA circuits are invalid or abnormal. It cannot be sure which stage of the GOA circuit units 11 is invalid. This increases the difficulty in repairing the GOA circuit units.

SUMMARY

The objective of the present invention is to provide a display panel for improving accuracy in GOA circuit invalid detection.

To achieve above objective, an aspect of the present invention provides a display panel, including a display region and a non-display region, the display region including a plurality of pixel units formed by interlacing a plurality of scan lines and a plurality of data lines, the display panel further including: a plurality of cascading gate-driver-on-array (GOA) circuit units, disposed in the non-display region and located at a side of the display region, the GOA circuit units connecting to the scan lines of the display region, the GOA circuit units divided into a plurality of groups of GOA circuit units according to an order of stages, each group of GOA circuit units having a same number of the GOA circuit units; a test line, connecting to a last stage of the GOA circuit units in each group of GOA circuit units via a connecting line, a number of the groups of GOA circuit units equal to a number of the connecting lines, the test line configured to treat one group of GOA circuit units as a unit and detect whether any GOA circuit unit in each group is invalid; and a plurality of virtual GOA circuit regions, disposed corresponding to the groups of GOA electric circuits, a number of the virtual GOA circuit regions equal to a number of the groups of GOA electric circuits, the virtual GOA circuit regions having circuits with a function as the same as the GOA circuit units, the virtual GOA circuit regions configured to replace invalid GOA circuit units, the invalid GOA circuit units replaced by the virtual GOA circuit regions corresponding to the groups different from the groups of the invalid GOA circuit units.

Another aspect of the present invention provides a display panel, including a display region and a non-display region, the display region including a plurality of pixel units formed by interlacing a plurality of scan lines and a plurality of data lines, the display panel further including: a plurality of cascading gate-driver-on-array (GOA) circuit units, disposed in the non-display region and located at a side of the display region, the GOA circuit units connecting to the scan lines of the display region, the GOA circuit units divided into a plurality of groups of GOA circuit units according to an order of stages, each group of GOA circuit units having a same number of the GOA circuit units; and a test line, connecting to a last stage of the GOA circuit units in each group of GOA circuit units via a connecting line, a number of the groups of GOA circuit units equal to a number of the connecting lines, the test line configured to treat one group of GOA circuit units as a unit and detect whether any GOA circuit unit in each group is invalid.

According to an embodiment of the present invention, each GOA circuit unit in each group of GOA circuit units except the last stage of the GOA circuit units is connected to the connecting line via a secondary connecting line, and the test line is configured to detect which one of the GOA circuit units in an invalid group of GOA circuit units is invalid after determining the invalid group of GOA circuit units.

According to an embodiment of the present invention, the test line carries an output signal of the last stage of the GOA circuit units in each group of GOA circuit units, which is compared to a normal signal of the last stage of the GOA circuit units in each group of GOA circuit units to detect which group of GOA circuit units has the invalid GOA circuit units.

According to an embodiment of the present invention, the test line carries an output signal of the last stage of the GOA circuit units in a current group of GOA circuit units, which is compared to an output terminal of the last stage of GOA circuit units in an adjacent group of GOA circuit units adjacent to the current group of GOA circuit units to determine whether the current group of GOA circuit units has the invalid GOA circuit units.

According to an embodiment of the present invention, when an interval between the output signal of the last stage of the GOA circuit units in the current group of GOA circuit units and the output signal of the last stage of the GOA circuit units in the adjacent group of GOA circuit units is not equal to a predetermined interval, the current group of GOA circuit units is determined to have the invalid GOA circuit units; when the interval between the output signal of the last stage of the GOA circuit units in the current group of GOA circuit units and the output signal of the last stage of the GOA circuit units in the adjacent group of GOA circuit units is equal to the predetermined interval, the GOA circuit units of the current group of GOA circuit units are valid.

According to an embodiment of the present invention, the display panel further includes: a plurality of virtual GOA circuit regions, disposed corresponding to the groups of GOA electric circuits, a number of the virtual GOA circuit regions equal to a number of the groups of GOA electric circuits, the virtual GOA circuit regions having circuits with a function as the same as the GOA circuit units, the virtual GOA circuit regions configured to replace invalid GOA circuit units.

According to an embodiment of the present invention, the invalid GOA circuit units replaced by the virtual GOA circuit regions corresponding to the groups different from the groups of the invalid GOA circuit units.

According to an embodiment of the present invention, the display panel further includes: a repair line, connecting to an active virtual GOA circuit region used to replace the invalid GOA circuit units, the repair line carrying a repair signal, which is transmitted to the active virtual GOA circuit region and is adjusted based on locations of the invalid GOA circuit units.

According to an embodiment of the present invention, each group of GOA circuit units includes m stages of the GOA circuit units, where m is a positive integer greater than 2. In the present invention, one group of GOA circuit units is treated as a unit to detect whether any GOA circuit unit in each group is invalid. Compared to the existing arts, more accurate GOA invalid detection is achieved in the present invention. GOA yield rate is improved. The present invention can further detect which one of the GOA circuit units in the invalid group of GOA circuit units is invalid, thereby precisely locating invalid GOA circuit units. In the present invention, the virtual GOA circuit regions are disposed to replace the invalid GOA circuit units, thereby solving a problem that manufacturing cost cannot be effectively reduced. Moreover, one advantage of the present invention is that lots of stages of the GOA circuit units can be repaired by using the virtual GOA circuit regions of different groups.

BRIEF DESCRIPTION OF DRAWINGS

To make above content of the present invention more easily understood, it will be described in details by using preferred embodiments in conjunction with the appending drawings.

DETAILED DESCRIPTION OF PREFERRED EMBODIMENTS

To make the objectives, technical schemes, and effects of the present invention more clear and specific, the present invention is described in further detail below with reference to the embodiments in accompanying with the appending drawings. It should be understood that the specific embodiments described herein are merely for explaining the present invention, the term "embodiment" used in the context means an example, instance, or illustration, and the present invention is not limited thereto.

Figure 1:
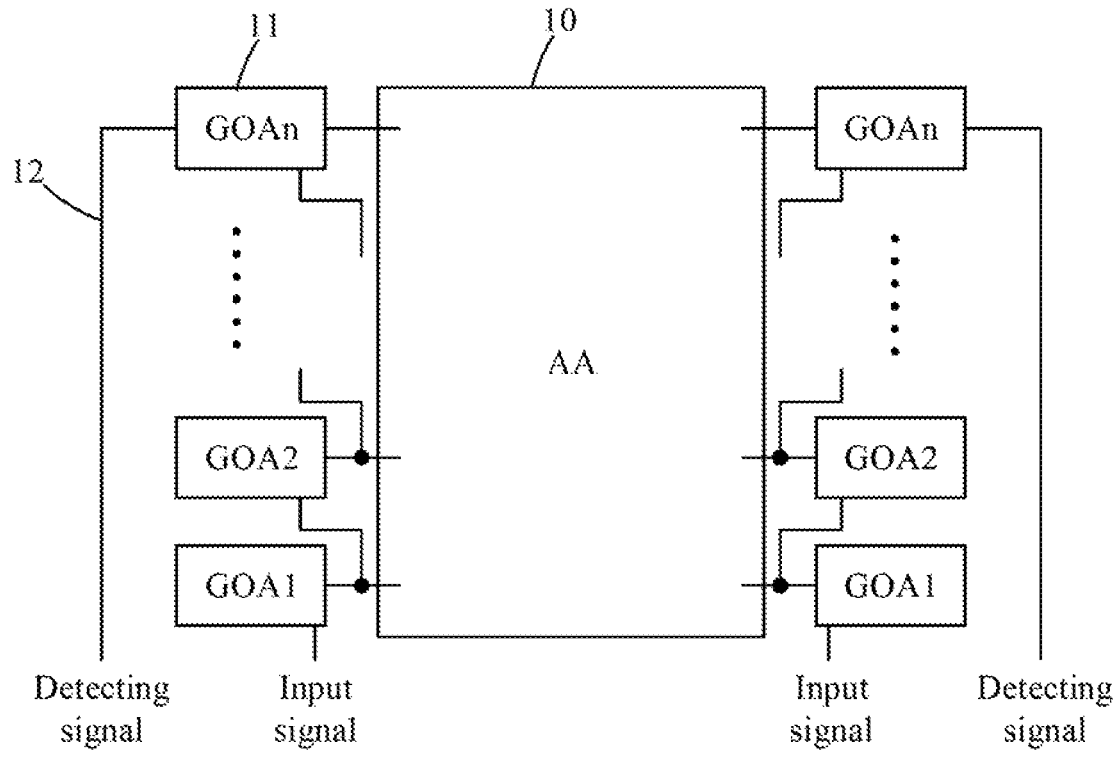
FIG. 1 is a schematic diagram showing an existing display panel.
Figure 2:
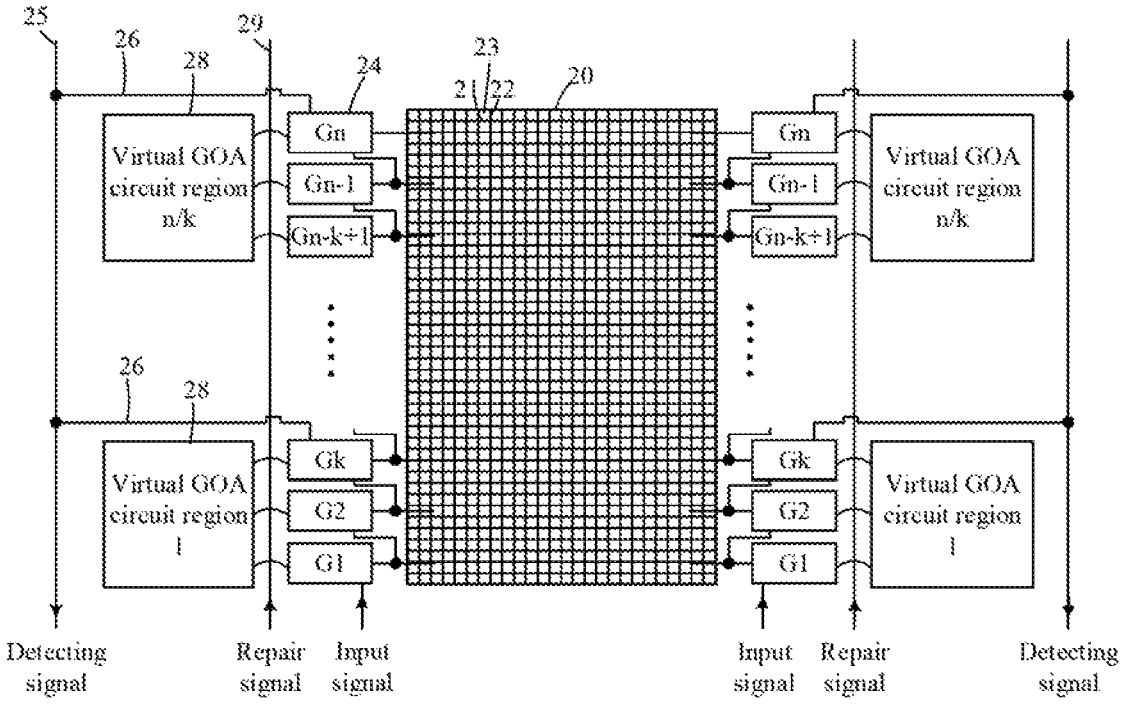
FIG. 2 is a schematic diagram showing a display panel according to the present invention.

FIG. 2 is a schematic diagram showing a display panel according to the present invention. For example, the display panel is a liquid crystal display panel. The display panel includes a display region (or called an active area, AA) 20 and a non-display region. The display region 20 includes a plurality of scan lines 21 and a plurality of data lines 22. The scan lines 21 are used to provide scan signals and the data lines 22 are used to provide data signals. The display region 20 further includes a plurality of pixel units 23 used for displaying images. The pixel units 23 are formed by interlacing the scan lines 21 and the data lines.

The display panel further includes a plurality of cascading gate-driver-on-array (GOA) circuit units (G1, G2, . . . , Gn) 24 implemented by GOA technology. The GOA circuit units 24 are disposed in the non-display region and are connected to the scan lines 21 of the display region 20. The GOA circuit units 24 is configured to provide stable scan signals to the scan lines 21 to achieve line-by-line or row-by-row scan driving. The GOA circuit units 24 may be disposed at only one side of the display panel. The GOA circuit units 24 may also be disposed at two opposite sides of the display panel and may provide the scan signals to the scan lines 21 in an alternative way. The following is illustrated by an example of the GOA circuit units disposed at only one side of the display panel. A person skilled in the art can understand that the GOA circuit units disposed at the other side of the display panel may function in a similar or the same way.

The GOA circuit units 24 are divided into a plurality of groups of GOA circuit units according to an order of stages. Each group of GOA circuit units includes a same number of the GOA circuit units. For example, every three GOA circuit units 24 is treated as one group. That is, a first stage to a third stage of the GOA circuit units are classified as one group and a fourth stage to a sixth stage are classified as another group, and so on. In a preferred embodiment, each group of GOA circuit units includes m stages of the GOA circuit units 24, where m is a positive integer greater than 2. That is, each group of GOA circuit units includes at least three GOA circuit units 24.

The display panel further includes a test line 25 disposed in the non-display region. A last stage of the GOA circuit units 24 in each group of GOA circuit units is connected to the test line 25 via a connecting line 26. In above example, the last stage of the GOA circuit units 24 in a first group of GOA circuit units is the third stage and the last stage of the GOA circuit units 24 in a second group of GOA circuit units is the sixth stage. The third stage of the GOA circuit units 24 is connected to the test line 25, the sixth stage of the GOA circuit units 24 is connected to the test line 25, and so on. The number of the groups of GOA circuit units is equal to the number of the connecting lines.

The test line 25 is configured to treat one group of GOA circuit units as a unit and detect whether any GOA circuit unit 24 in each group is invalid. Specifically, an input signal is provided to the first stage of the GOA circuit units 24. The input signal passes to the last stage of GOA circuit units 24 in each group of GOA circuit units. An output signal of the last stage of the GOA circuit units 24 is delivered to the test line 25 via the connecting line 26. The signals carried by the test line 25 are detecting signals.

The present invention can detect whether each group of GOA circuit units has invalid GOA circuit units 24 by the following two ways. Specifically, by detecting the output signal of the last stage of the GOA circuit units 24 in each group of GOA circuit units, it can be known that whether there is any invalid GOA circuit unit 24 in a group. For example, if the output signal of the last stage of the GOA circuit units 24 in a m-th group of GOA circuit units has problems, it can be known that at least one of the GOA circuit units 24 in the m-th group of GOA circuit units is invalid.

Figure 3:
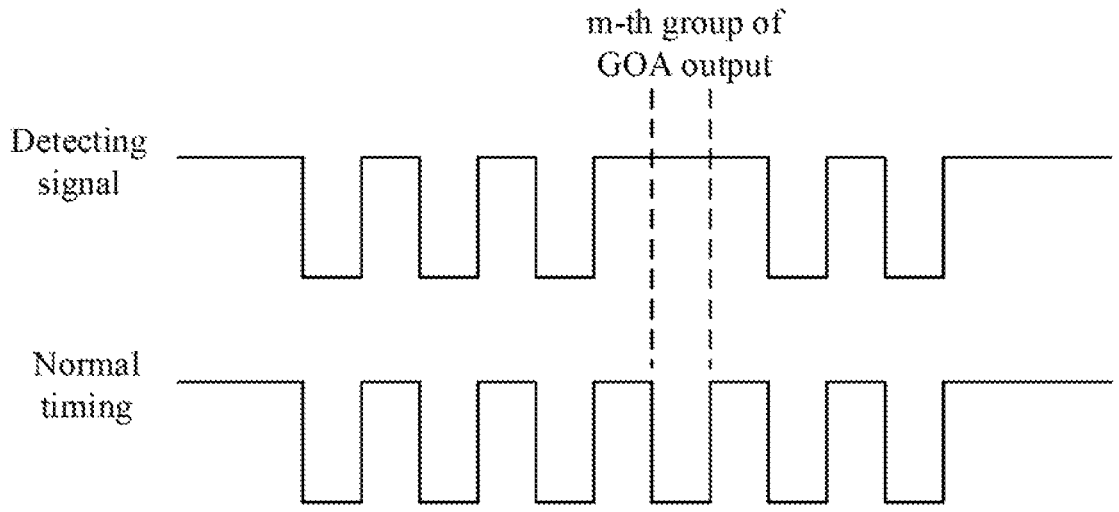
FIG. 3 is a schematic diagram showing a detect signal and a normal timing according to the present invention.

In a first approach, the output signal of the last stage of the GOA circuit units 24 in each group of GOA circuit units, carried by the test line 25, is compared to a normal signal of the last stage of the GOA circuit units 24 in each group of GOA circuit units to detect which group of GOA circuit units has the invalid GOA circuit units 24. As shown in FIG. 3, a detecting signal carried by the test line 25 is compared to a normal timing. In the normal timing, the output of a m-th group of GOA should be a low voltage level signal. However, in the detecting signal, the outputted voltage level of the m-th group of GOA is zero. Accordingly, it can be determined that the m-th group of GOA circuit units has the invalid GOA circuit units 24.

In a second approach, the output signal of the last stage of the GOA circuit units 24 in a current group of GOA circuit units, carried by the test line 25, is compared to the output terminal of the last stage of GOA circuit units 24 in an adjacent group of GOA circuit units adjacent to the current group of GOA circuit units to determine whether the current group of GOA circuit units has the invalid GOA circuit units 24.

Specifically, when an interval between the output signal of the last stage of the GOA circuit units 24 in the current group of GOA circuit units and the output signal of the last stage of the GOA circuit units 24 in the adjacent group of GOA circuit units is not equal to a predetermined interval (or a phase difference between them is not equal to a predetermined phase difference), the current group of GOA circuit units is determined to have the invalid GOA circuit units 24. When the interval between the output signal of the last stage of the GOA circuit units 24 in the current group of GOA circuit units and the output signal of the last stage of the GOA circuit units 24 in the adjacent group of GOA circuit units is equal to the predetermined interval (or the phase difference between them is equal to the predetermined phase difference), the GOA circuit units 24 of the current group of GOA circuit units are valid.

Figure 4:
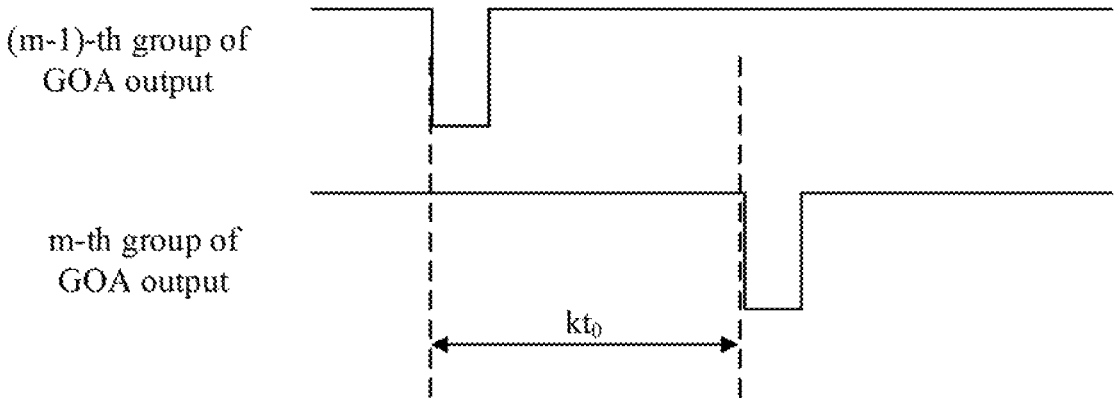
FIG. 4 is a schematic diagram showing output signals of adjacent GOAs according to the present invention.

As shown in FIG. 4, the output signal of a m-th group of GOA is compared to the output signal of a (m−1)-th group of GOA. If a timing difference (corresponding to the aforementioned interval and phase difference) between the output signals of them is equal to a predetermined value (e.g., $kt_0$), it can be determined that the GOA circuit units 24 of the m-th group of GOA circuit units are valid; otherwise, it can be determined that at least one of the GOA circuit units 24 of the m-th group of GOA circuit units is invalid.

Figure 5:
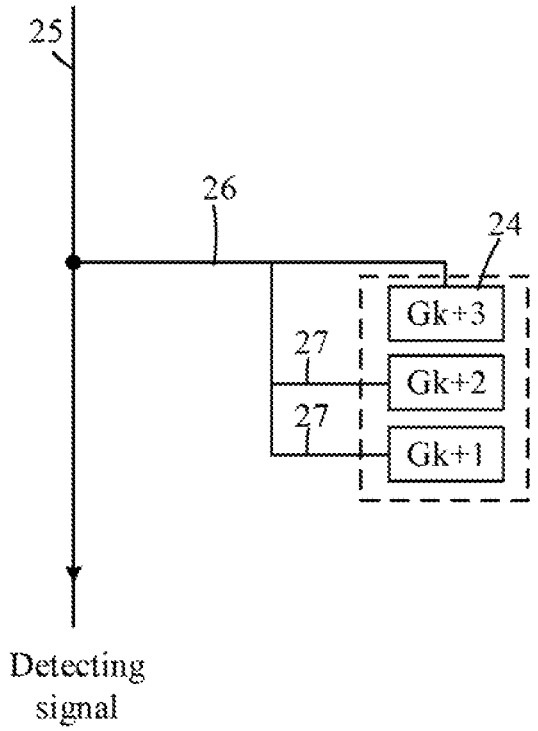
FIG. 5 is a schematic diagram showing connections between a test line and groups of GOA circuit units according to the present invention.

FIG. 5 is a schematic diagram showing connections between the test line 25 and the groups of GOA circuit units according to the present invention. Only one group of GOA circuit units is shown in FIG. 5. Other groups of GOA circuit units and the test line 25 are connected in a same way. As shown in FIG. 5, each GOA circuit unit 24 in each group of GOA circuit units except the last stage of the GOA circuit units 24 is connected to the connecting line 26 via a secondary connecting line 27. For example, a GOA circuit unit Gk+3 is connected to the test line 25 via the connecting line 26. Each of GOA circuit units Gk+1 and Gk+2 is connected to the test line 25 via the connecting line 26 and one secondary connecting line 27.

After an invalid group of GOA circuit units is determined, the test line 25 can further detect which one of the GOA circuit units 24 in the invalid group of GOA circuit units is invalid. Specifically, after which one group of GOA circuit units is invalid is detected, an approach similar to the afore-described first or second approach can be further utilized to detect which one of the GOA circuit units 24 in said group is invalid to locate invalid GOA circuit units 24.

In the present invention, a plurality of cascading GOA circuit units 24 are divided into a plurality of groups of GOA circuit units. The last stage of the GOA circuit units 24 in each group of GOA circuit units is connected to the test line 25. In the present invention, one group of GOA circuit units is treated as a unit to detect whether any GOA circuit unit 24 in each group is invalid. Compared to the existing arts, more accurate GOA invalid detection is achieved in the present invention. GOA yield rate is improved. After an invalid group of GOA circuit units is determined, the present invention can further detect which one of the GOA circuit units 24 in the invalid group of GOA circuit units is invalid, thereby precisely locating invalid GOA circuit units 24.

Please continue to FIG. 2. The display panel further includes a plurality of virtual GOA circuit regions 28. The virtual GOA circuit regions 28 are disposed corresponding to the groups of GOA circuit units. The number of the virtual GOA circuit regions 28 is equal to the number of the groups of GOA electric circuits. The virtual GOA circuit regions 28 has circuits with a function as the same as the GOA circuit units 24.

In one embodiment, the virtual GOA circuit regions 28 may have a circuit corresponding to one GOA circuit unit 24. When one invalid GOA circuit unit 24 exists in a certain group of GOA circuit units, the one invalid GOA circuit unit 24 is replaced with a circuit in the virtual GOA circuit region 28 disposed corresponding to said group. When two or more than two invalid GOA circuit units 24 exist in a certain group of GOA circuit units, one of the invalid GOA electric circuits 24 is replaced with a circuit in the virtual GOA circuit region 28 disposed corresponding to said group, and the other ones of the invalid GOA circuit units 24 are replaced with circuits in the virtual GOA circuit regions 28 disposed corresponding to other groups. That is, the invalid GOA circuit units 24 are replaced by the virtual GOA circuit regions 28 corresponding to the groups different from the groups of the invalid GOA circuit units.

In another embodiment, the virtual GOA circuit regions 28 may have a circuit corresponding to one group of GOA circuit unit. For example, one group of GOA circuit units includes three GOA circuit units 24. One virtual GOA circuit region 28 has a circuit disposed corresponding to the three GOA circuit units 24. In such a way, when one or at least one invalid GOA circuit unit 24 exists in a certain group of GOA circuit units, the group of GOA circuit units can be directly replaced with the virtual GOA circuit region 28 corresponding to said group.

The display panel further includes a repair line 29. The repair line 29 is disposed between each GOA circuit unit 24 and each virtual GOA circuit region 28. The repair line 29 is connected to an active virtual GOA circuit region 28 used to replace the invalid GOA circuit units 28. For example, circuits in the virtual GOA circuit regions 28 and lead wires of the GOA circuit units 24 are disposed at a same layer. The repair line 29 is disposed at another layer with respect to the lead wires. They are separated by insulating material. The repair line 29 can conduct circuits in the virtual GOA circuit regions 28 to the GOA circuit units by laser melting. For example, if a k-th stage of the GOA circuit units 24 is invalid, the laser melting can be used to disconnect the invalid GOA circuit unit 24 from the scan lines and connect a circuit in the virtual GOA circuit region 28 to a (k+1)-th stage of the GOA circuit units 24 to replace the invalid k-th stage of the GOA circuit units 24.

By the repair line 29, the invalid GOA circuit units 24 in a current group can also be replaced with the virtual GOA circuit regions 28 corresponding to the groups different from the current group. For example, a k-th stage and a (k+1)-th stage of the GOA circuit units in a m-th group of GOA circuit units are invalid, the laser melting is utilized to disconnect the invalid k-th stage and (k+1)-th stage of the GOA circuit units 24 from the scan lines 21, and connect a circuit (for replacing the k-th stage) in the virtual GOA circuit region 28 of a same group to a circuit (for replacing the (k+1)-th stage) in the virtual GOA circuit region 28 of a next group and then connect the circuit in the virtual GOA circuit region 28 of the next group to a (k+2)-th stage of the GOA circuit units 24 by using the repair line 29.

The repair line 29 carries a repair signal, which is transmitted to an active virtual GOA circuit region 28 and is adjusted based on locations of the invalid GOA circuit units 24. That is to say, the timing of the repair signal may be correspondingly adjusted according to the timing of the invalid GOA circuit units 24 such that the timing the scan signals transmitted to the scan lines 21 is returned to normal.

In the present invention, a plurality of virtual GOA circuit regions capable of replacing invalid GOA circuit units are disposed in the display panel. In the existing arts, display panels may have to be scrapped due to invalid GOA circuit units and thus manufacturing cost cannot be effectively reduced. The present invention can solve such problems. Moreover, when the display panel has a plurality of groups or a plurality of stages of the GOA circuit units that are invalid, the present invention can repair lots of stages of the GOA circuit units 24 by using the virtual GOA circuit regions of different groups. This is a great advantage of the present invention.

Figure 6:
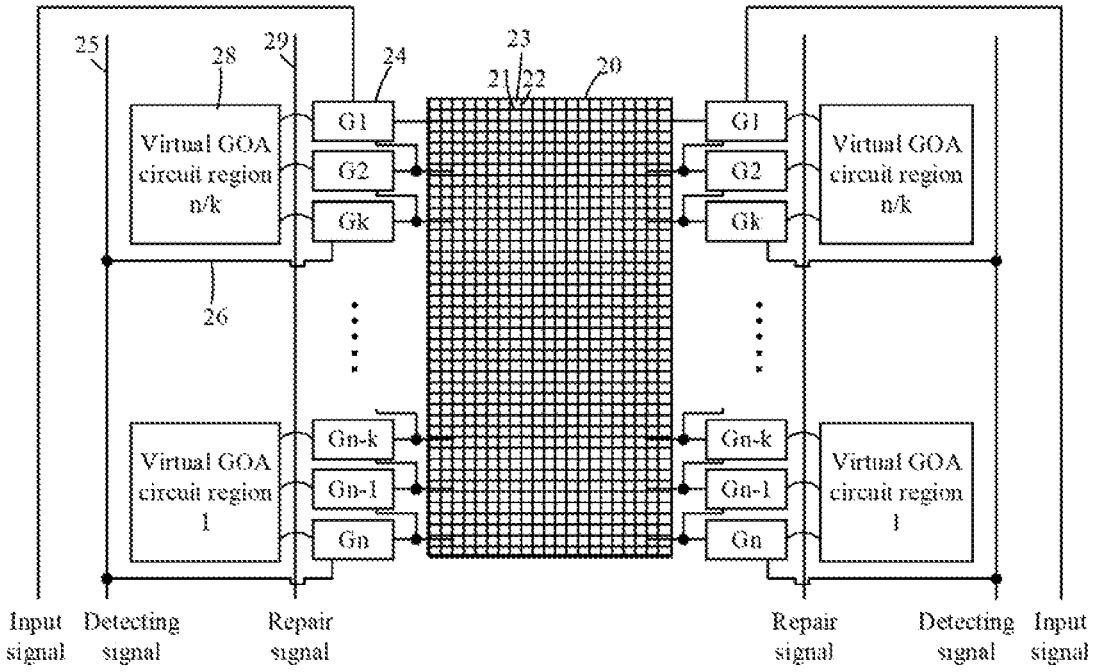
FIG. 6 is a schematic diagram showing a display panel according to the present invention.

In addition to forward GOA scanning from top to bottom in the embodiment shown in FIG. 2, the present invention is applicable to backward GOA scanning from bottom to top, as shown in FIG. 6.

Above all, while the preferred embodiments of the present disclosure have been illustrated and described in detail, it is intended that the present disclosure should not be limited to the preferred embodiment. Various modifications and alterations which maintain the realm of the present disclosure can be made by persons skilled in this art. The protective scope of the present disclosure is subject to the scope as defined in the claims.

The invention claimed is:

1. A display panel, comprising a display region and a non-display region, the display region comprising a plurality of pixel units formed by interlacing a plurality of scan lines and a plurality of data lines, the display panel further comprising:

a plurality of cascading gate-driver-on-array (GOA) circuit units, disposed in the non-display region and located at a side of the display region, the GOA circuit units connecting to the scan lines of the display region, the GOA circuit units divided into a plurality of groups of GOA circuit units according to an order of stages, each group of GOA circuit units having a same number of the GOA circuit units;

a test line, connecting to a last stage of the GOA circuit units in each group of GOA circuit units via a connecting line, a number of the groups of GOA circuit units equal to a number of the connecting lines, the test line configured to treat one group of GOA circuit units as a unit and detect whether any GOA circuit unit in each group is invalid; and a plurality of virtual GOA circuit regions, disposed corresponding to the groups of GOA electric circuits, a number of the virtual GOA circuit regions equal to a number of the groups of GOA electric circuits, the virtual GOA circuit regions having circuits with a function as the same as the GOA circuit units, the virtual GOA circuit regions configured to replace invalid GOA circuit units, the invalid GOA circuit units replaced by the virtual GOA circuit regions corresponding to the groups different from the groups of the invalid GOA circuit units.

2. The display panel according to claim 1, wherein each GOA circuit unit in each group of GOA circuit units except the last stage of the GOA circuit units is connected to the connecting line via a secondary connecting line, and the test line is configured to detect which one of the GOA circuit units in an invalid group of GOA circuit units is invalid after determining the invalid group of GOA circuit units.

3. The display panel according to claim 1, wherein the test line carries an output signal of the last stage of the GOA circuit units in each group of GOA circuit units, which is compared to a normal signal of the last stage of the GOA circuit units in each group of GOA circuit units to detect which group of GOA circuit units has the invalid GOA circuit units.

4. The display panel according to claim 1, wherein the test line carries an output signal of the last stage of the GOA circuit units in a current group of GOA circuit units, which is compared to an output terminal of the last stage of GOA circuit units in an adjacent group of GOA circuit units adjacent to the current group of GOA circuit units to determine whether the current group of GOA circuit units has the invalid GOA circuit units.

5. The display panel according to claim 4, wherein when an interval between the output signal of the last stage of the GOA circuit units in the current group of GOA circuit units and the output signal of the last stage of the GOA circuit units in the adjacent group of GOA circuit units is not equal to a predetermined interval, the current group of GOA circuit units is determined to have the invalid GOA circuit units; when the interval between the output signal of the last stage of the GOA circuit units in the current group of GOA circuit units and the output signal of the last stage of the GOA circuit units in the adjacent group of GOA circuit units is equal to the predetermined interval, the GOA circuit units of the current group of GOA circuit units are valid.

6. The display panel according to claim 1, further comprising:

a repair line, connecting to an active virtual GOA circuit region used to replace the invalid GOA circuit units, the repair line carrying a repair signal, which is transmitted to the active virtual GOA circuit region and is adjusted based on locations of the invalid GOA circuit units.

7. The display panel according to claim 1, wherein each group of GOA circuit units comprises m stages of the GOA circuit units, where m is a positive integer greater than 2.

8. A display panel, comprising a display region and a non-display region, the display region comprising a plurality of pixel units formed by interlacing a plurality of scan lines and a plurality of data lines, the display panel further comprising:

a plurality of cascading gate-driver-on-array (GOA) circuit units, disposed in the non-display region and located at a side of the display region, the GOA circuit units connecting to the scan lines of the display region, the GOA circuit units divided into a plurality of groups of GOA circuit units according to an order of stages, each group of GOA circuit units having a same number of the GOA circuit units; and a test line, connecting to a last stage of the GOA circuit units in each group of GOA circuit units via a connecting line, a number of the groups of GOA circuit units equal to a number of the connecting lines, the test line configured to treat one group of GOA circuit units as a unit and detect whether any GOA circuit unit in each group is invalid.

9. The display panel according to claim 8, wherein each GOA circuit unit in each group of GOA circuit units except the last stage of the GOA circuit units is connected to the connecting line via a secondary connecting line, and the test line is configured to detect which one of the GOA circuit units in an invalid group of GOA circuit units is invalid after determining the invalid group of GOA circuit units.

10. The display panel according to claim 8, wherein the test line carries an output signal of the last stage of the GOA circuit units in each group of GOA circuit units, which is compared to a normal signal of the last stage of the GOA circuit units in each group of GOA circuit units to detect which group of GOA circuit units has the invalid GOA circuit units.

11. The display panel according to claim 8, wherein the test line carries an output signal of the last stage of the GOA circuit units in a current group of GOA circuit units, which is compared to an output terminal of the last stage of GOA circuit units in an adjacent group of GOA circuit units adjacent to the current group of GOA circuit units to determine whether the current group of GOA circuit units has the invalid GOA circuit units.

12. The display panel according to claim 11, wherein when an interval between the output signal of the last stage of the GOA circuit units in the current group of GOA circuit units and the output signal of the last stage of the GOA circuit units in the adjacent group of GOA circuit units is not equal to a predetermined interval, the current group of GOA circuit units is determined to have the invalid GOA circuit units; when the interval between the output signal of the last stage of the GOA circuit units in the current group of GOA circuit units and the output signal of the last stage of the GOA circuit units in the adjacent group of GOA circuit units is equal to the predetermined interval, the GOA circuit units of the current group of GOA circuit units are valid.

13. The display panel according to claim 8, further comprising:

a plurality of virtual GOA circuit regions, disposed corresponding to the groups of GOA electric circuits, a number of the virtual GOA circuit regions equal to a number of the groups of GOA electric circuits, the virtual GOA circuit regions having circuits with a function as the same as the GOA circuit units, the virtual GOA circuit regions configured to replace invalid GOA circuit units.

14. The display panel according to claim 13, wherein the invalid GOA circuit units replaced by the virtual GOA circuit regions corresponding to the groups different from the groups of the invalid GOA circuit units.

15. The display panel according to claim 13, further comprising:

a repair line, connecting to an active virtual GOA circuit region used to replace the invalid GOA circuit units, the repair line carrying a repair signal, which is transmitted to the active virtual GOA circuit region and is adjusted based on locations of the invalid GOA circuit units.

16. The display panel according to claim 8, wherein each group of GOA circuit units comprises m stages of the GOA circuit units, where m is a positive integer greater than 2.

* * * * *